US007845418B2

(12) United States Patent
Shahin et al.

(10) Patent No.: US 7,845,418 B2
(45) Date of Patent: Dec. 7, 2010

(54) TOP DRIVE TORQUE BOOSTER

(75) Inventors: David Shahin, Houston, TX (US); Karsten Heidecke, Houston, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 85 days.

(21) Appl. No.: 11/334,781

(22) Filed: Jan. 18, 2006

(65) Prior Publication Data

US 2006/0180315 A1 Aug. 17, 2006

Related U.S. Application Data

(60) Provisional application No. 60/644,661, filed on Jan. 18, 2005.

(51) Int. Cl.
*E21B 19/16* (2006.01)

(52) U.S. Cl. ..... 166/380; 166/379; 166/78.1; 175/113; 173/164

(58) Field of Classification Search ..... 166/379, 166/380, 78.1; 175/85, 162, 113; 173/164
See application file for complete search history.

(56) References Cited

U.S. PATENT DOCUMENTS

| | | | |
|---|---|---|---|
| 179,973 | A | 7/1876 | Thornton |
| 1,414,207 | A | 4/1922 | Reed |
| 1,418,766 | A | 8/1922 | Wilson |
| 1,585,069 | A | 5/1926 | Youle |
| 1,728,136 | A | 9/1929 | Power |
| 1,777,592 | A | 10/1930 | Thomas |
| 1,805,007 | A | 5/1931 | Pedley |
| 1,825,026 | A | 9/1931 | Thomas |
| 1,842,638 | A | 1/1932 | Wigle |
| 1,917,135 | A | 7/1933 | Littell |
| 2,105,885 | A | 1/1938 | Hinderliter |
| 2,128,430 | A | 8/1938 | Pryor |
| 2,167,338 | A | 7/1939 | Murcell |
| 2,184,681 | A | 12/1939 | Osmun et al. |
| 2,214,429 | A | 9/1940 | Miller |
| 2,414,719 | A | 1/1947 | Cloud |
| 2,522,444 | A | 9/1950 | Grable |
| 2,536,458 | A | 1/1951 | Munsinger |
| 2,570,080 | A | 10/1951 | Stone |

(Continued)

FOREIGN PATENT DOCUMENTS

| | | |
|---|---|---|
| CA | 2 307 386 | 11/2000 |

(Continued)

OTHER PUBLICATIONS

"First Success with Casing-Drilling" Word Oil, Feb. (1999), pp. 25.

(Continued)

*Primary Examiner*—Jennifer H Gay
*Assistant Examiner*—Sean D Andrish
(74) *Attorney, Agent, or Firm*—Patterson & Sheridan, LLP

(57) ABSTRACT

A method and apparatus for providing additional torque in a top drive system for rotating a tubular during tubular drilling, running, and/or handling operations. In one embodiment, a gear arrangement is operatively connected to a top drive of the top drive system to increase the amount of available torque for rotating a tubular. In another embodiment, a gear box is operatively connected to the top drive to boost the amount of torque available for rotating the tubular.

36 Claims, 3 Drawing Sheets

U.S. PATENT DOCUMENTS

| | | | |
|---|---|---|---|
| 2,582,987 | A | 1/1952 | Hagenbook |
| 2,595,902 | A | 5/1952 | Stone |
| 2,610,690 | A | 9/1952 | Beatty |
| 2,641,444 | A | 6/1953 | Moon |
| 2,668,689 | A | 2/1954 | Cormany |
| 2,692,059 | A | 10/1954 | Bolling, Jr. |
| 2,953,406 | A | 9/1960 | Young |
| 2,965,177 | A | 12/1960 | Bus, Sr., et al. |
| 3,041,901 | A | 7/1962 | Knights |
| 3,087,546 | A | 4/1963 | Wooley |
| 3,122,811 | A | 3/1964 | Gilreath |
| 3,191,683 | A | 6/1965 | Alexander |
| 3,193,116 | A | 7/1965 | Kenneday et al. |
| 3,266,582 | A | 8/1966 | Homanick |
| 3,305,021 | A | 2/1967 | Lebourg |
| 3,321,018 | A | 5/1967 | McGill |
| 3,380,528 | A | 4/1968 | Timmons |
| 3,392,609 | A | 7/1968 | Bartos |
| 3,477,527 | A | 11/1969 | Koot |
| 3,489,220 | A | 1/1970 | Kinley |
| 3,518,903 | A | 7/1970 | Ham et al. |
| 3,548,936 | A | 12/1970 | Kilgore et al. |
| 3,552,507 | A | 1/1971 | Brown |
| 3,552,508 | A | 1/1971 | Brown |
| 3,552,509 | A | 1/1971 | Brown |
| 3,552,510 | A | 1/1971 | Brown |
| 3,566,505 | A | 3/1971 | Martin |
| 3,570,598 | A | 3/1971 | Johnson |
| 3,602,302 | A | 8/1971 | Kluth |
| 3,606,664 | A | 9/1971 | Weiner |
| 3,635,105 | A | 1/1972 | Dickmann et al. |
| 3,638,989 | A | 2/1972 | Sandquist |
| 3,662,842 | A | 5/1972 | Bromell |
| 3,680,412 | A | 8/1972 | Mayer et al. |
| 3,691,825 | A | 9/1972 | Dyer |
| 3,697,113 | A | 10/1972 | Palauro et al. |
| 3,700,048 | A | 10/1972 | Desmoulins |
| 3,706,347 | A | 12/1972 | Brown |
| 3,746,330 | A | 7/1973 | Taciuk |
| 3,747,675 | A | 7/1973 | Brown |
| 3,766,991 | A | 10/1973 | Brown |
| 3,776,320 | A | 12/1973 | Brown |
| 3,780,883 | A | 12/1973 | Brown |
| 3,808,916 | A | 5/1974 | Porter et al. |
| 3,838,613 | A | 10/1974 | Wilms |
| 3,840,128 | A | 10/1974 | Swoboda, Jr. et al. |
| 3,848,684 | A | 11/1974 | West |
| 3,857,450 | A | 12/1974 | Guier |
| 3,871,618 | A | 3/1975 | Funk |
| 3,881,375 | A | 5/1975 | Kelly |
| 3,885,679 | A | 5/1975 | Swoboda, Jr. et al. |
| 3,901,331 | A | 8/1975 | Djurovic |
| 3,913,687 | A | 10/1975 | Gyongyosi et al. |
| 3,915,244 | A | 10/1975 | Brown |
| 3,961,399 | A | 6/1976 | Boyadjieff |
| 3,964,552 | A | 6/1976 | Slator |
| 3,980,143 | A | 9/1976 | Swartz et al. |
| 4,054,332 | A | 10/1977 | Bryan, Jr. |
| 4,077,525 | A | 3/1978 | Callegari et al. |
| 4,100,968 | A | 7/1978 | Delano |
| 4,127,927 | A | 12/1978 | Hauk et al. |
| 4,142,739 | A | 3/1979 | Billingsley |
| 4,202,225 | A | 5/1980 | Sheldon et al. |
| 4,221,269 | A | 9/1980 | Hudson |
| 4,257,442 | A | 3/1981 | Claycomb |
| 4,262,693 | A | 4/1981 | Giebeler |
| 4,274,777 | A | 6/1981 | Scaggs |
| 4,274,778 | A | 6/1981 | Putnam et al. |
| 4,280,380 | A | 7/1981 | Eshghy |
| 4,315,553 | A | 2/1982 | Stallings |
| 4,320,915 | A | 3/1982 | Abbott et al. |
| 4,401,000 | A | 8/1983 | Kinzbach |
| 4,437,363 | A | 3/1984 | Haynes |
| 4,440,220 | A | 4/1984 | McArthur |
| 4,446,745 | A | 5/1984 | Stone et al. |
| 4,449,596 | A | 5/1984 | Boyadjieff |
| 4,472,002 | A | 9/1984 | Beney et al. |
| 4,489,794 | A | 12/1984 | Boyadjieff |
| 4,492,134 | A | 1/1985 | Reinholdt et al. |
| 4,494,424 | A | 1/1985 | Bates |
| 4,515,045 | A | 5/1985 | Gnatchenko et al. |
| 4,529,045 | A | 7/1985 | Boyadjieff et al. |
| 4,570,706 | A | 2/1986 | Pugnet |
| 4,592,125 | A | 6/1986 | Skene |
| 4,593,584 | A | 6/1986 | Neves |
| 4,593,773 | A | 6/1986 | Skeie |
| 4,604,724 | A | 8/1986 | Shaginian et al. |
| 4,604,818 | A | 8/1986 | Inoue |
| 4,605,077 | A | 8/1986 | Boyadjieff |
| 4,613,161 | A | 9/1986 | Brisco |
| 4,625,796 | A | 12/1986 | Boyadjieff |
| 4,646,827 | A | 3/1987 | Cobb |
| 4,649,777 | A | 3/1987 | Buck |
| 4,652,195 | A | 3/1987 | McArthur |
| 4,667,752 | A | 5/1987 | Berry et al. |
| 4,676,312 | A | 6/1987 | Mosing et al. |
| 4,681,158 | A | 7/1987 | Pennison |
| 4,681,162 | A | 7/1987 | Boyd |
| 4,683,962 | A | 8/1987 | True |
| 4,686,873 | A | 8/1987 | Lang et al. |
| 4,709,599 | A | 12/1987 | Buck |
| 4,709,766 | A | 12/1987 | Boyadjieff |
| 4,725,179 | A | 2/1988 | Woolslayer et al. |
| 4,735,270 | A | 4/1988 | Fenyvesi |
| 4,738,145 | A | 4/1988 | Vincent et al. |
| 4,742,876 | A | 5/1988 | Barthelemy et al. |
| 4,759,239 | A | 7/1988 | Hamilton et al. |
| 4,762,187 | A | 8/1988 | Haney |
| 4,765,401 | A | 8/1988 | Boyadjieff |
| 4,765,416 | A | 8/1988 | Bjerking et al. |
| 4,773,689 | A | 9/1988 | Wolters |
| 4,781,359 | A | 11/1988 | Matus |
| 4,791,997 | A | 12/1988 | Krasnov |
| 4,793,422 | A | 12/1988 | Krasnov |
| 4,800,968 | A | 1/1989 | Shaw et al. |
| 4,813,493 | A | 3/1989 | Shaw et al. |
| 4,813,495 | A | 3/1989 | Leach |
| 4,815,546 | A | 3/1989 | Haney et al. |
| 4,821,814 | A | 4/1989 | Willis et al. |
| 4,832,552 | A | 5/1989 | Skelly |
| 4,836,064 | A | 6/1989 | Slator |
| 4,843,945 | A | 7/1989 | Dinsdale |
| 4,867,236 | A | 9/1989 | Haney et al. |
| 4,875,530 | A | 10/1989 | Frink et al. |
| 4,878,546 | A | 11/1989 | Shaw et al. |
| 4,899,816 | A | 2/1990 | Mine |
| 4,909,741 | A | 3/1990 | Schasteen et al. |
| 4,921,386 | A | 5/1990 | McArthur |
| 4,936,382 | A | 6/1990 | Thomas |
| 4,962,579 | A | 10/1990 | Moyer et al. |
| 4,962,819 | A | 10/1990 | Bailey et al. |
| 4,971,146 | A | 11/1990 | Terrell |
| 4,997,042 | A | 3/1991 | Jordan et al. |
| 5,022,472 | A | 6/1991 | Bailey et al. |
| 5,036,927 | A | 8/1991 | Willis |
| 5,049,020 | A | 9/1991 | McArthur |
| 5,060,542 | A | 10/1991 | Hauk |
| 5,062,756 | A | 11/1991 | McArthur et al. |
| 5,107,940 | A | 4/1992 | Berry |
| 5,111,893 | A | 5/1992 | Kvello-Aune |
| RE34,063 | E | 9/1992 | Vincent et al. |
| 5,191,939 | A | 3/1993 | Stokley |
| 5,207,128 | A | 5/1993 | Albright |
| 5,233,742 | A | 8/1993 | Gray et al. |

5,245,265 A 9/1993 Clay
5,251,709 A 10/1993 Richardson
5,255,751 A 10/1993 Stogner
5,272,925 A 12/1993 Henneuse et al.
5,282,653 A 2/1994 LaFleur et al.
5,284,210 A 2/1994 Helms et al.
5,294,228 A 3/1994 Willis et al.
5,297,833 A 3/1994 Willis et al.
5,305,839 A 4/1994 Kalsi et al.
5,332,043 A 7/1994 Ferguson
5,340,182 A 8/1994 Busink et al.
5,351,767 A 10/1994 Stogner et al.
5,354,150 A 10/1994 Canales
5,368,113 A 11/1994 Schulze-Beckinghausen
5,386,746 A 2/1995 Hauk
5,388,651 A 2/1995 Berry
5,433,279 A 7/1995 Tessari et al.
5,461,905 A 10/1995 Penisson
5,497,840 A 3/1996 Hudson
5,501,280 A 3/1996 Brisco
5,501,286 A 3/1996 Berry
5,503,234 A 4/1996 Clanton
5,535,824 A 7/1996 Hudson
5,575,344 A 11/1996 Wireman
5,577,566 A 11/1996 Albright et al.
5,584,343 A 12/1996 Coone
5,588,916 A 12/1996 Moore
5,645,131 A 7/1997 Trevisani
5,661,888 A 9/1997 Hanslik
5,667,026 A 9/1997 Lorenz et al.
5,706,894 A 1/1998 Hawkins, III
5,711,382 A 1/1998 Hansen et al.
5,735,348 A 4/1998 Hawkins, III
5,735,351 A 4/1998 Helms
5,746,276 A 5/1998 Stuart
5,765,638 A 6/1998 Taylor
5,772,514 A 6/1998 Moore
5,785,132 A 7/1998 Richardson et al.
5,791,410 A 8/1998 Castille et al.
5,803,191 A 9/1998 Mackintosh
5,806,589 A 9/1998 Lang
5,833,002 A 11/1998 Holcombe
5,836,395 A 11/1998 Budde
5,839,330 A 11/1998 Stokka
5,842,530 A 12/1998 Smith et al.
5,850,877 A 12/1998 Albright et al.
5,890,549 A 4/1999 Sprehe
5,909,768 A 6/1999 Castille et al.
5,931,231 A 8/1999 Mock
5,960,881 A 10/1999 Allamon et al.
5,971,079 A 10/1999 Mullins
5,971,086 A 10/1999 Bee et al.
6,000,472 A 12/1999 Albright et al.
6,012,529 A 1/2000 Mikolajczyk et al.
6,056,060 A 5/2000 Abrahamsen et al.
6,065,550 A 5/2000 Gardes
6,070,500 A 6/2000 Dlask et al.
6,079,509 A 6/2000 Bee et al.
6,119,772 A 9/2000 Pruet
6,142,545 A 11/2000 Penman et al.
6,161,617 A 12/2000 Gjedebo
6,170,573 B1 1/2001 Brunet et al.
6,173,777 B1 1/2001 Mullins
6,199,641 B1 3/2001 Downie et al.
6,202,784 B1 3/2001 Ables et al.
6,217,258 B1 4/2001 Yamamoto et al.
6,227,587 B1 5/2001 Terral
6,237,684 B1 5/2001 Bouligny, Jr. et al.
6,278,450 B1 8/2001 Seneviratne
6,279,654 B1 8/2001 Mosing et al.
6,309,002 B1 10/2001 Bouligny
6,311,792 B1 11/2001 Scott et al.
6,315,051 B1 11/2001 Ayling
6,334,376 B1 1/2002 Torres
6,349,764 B1 2/2002 Adams et al.
6,360,633 B2 3/2002 Pietras
6,378,630 B1 4/2002 Ritorto et al.
6,390,190 B2 5/2002 Mullins
6,412,554 B1 7/2002 Allen et al.
6,415,862 B1 7/2002 Mullins
6,431,626 B1 8/2002 Bouligny
6,443,241 B1 9/2002 Juhasz et al.
6,527,047 B1 3/2003 Pietras
6,527,493 B1 3/2003 Kamphorst et al.
6,536,520 B1 * 3/2003 Snider et al. ..... 166/78.1
6,553,825 B1 4/2003 Boyd
6,591,471 B1 7/2003 Hollingsworth et al.
6,595,288 B2 7/2003 Mosing et al.
6,622,796 B1 9/2003 Pietras
6,637,526 B2 10/2003 Juhasz et al.
6,651,737 B2 11/2003 Bouligny
6,668,684 B2 12/2003 Allen et al.
6,668,937 B1 12/2003 Murray
6,679,333 B2 1/2004 York et al.
6,688,394 B1 2/2004 Ayling
6,688,398 B2 2/2004 Pietras
6,691,801 B2 2/2004 Juhasz et al.
6,725,938 B1 4/2004 Pietras
6,725,949 B2 * 4/2004 Seneviratne ..... 175/85
6,732,822 B2 5/2004 Slack et al.
6,742,584 B1 6/2004 Appleton
6,742,596 B2 6/2004 Haugen
6,832,656 B2 12/2004 Fournier, Jr. et al.
6,832,658 B2 12/2004 Keast
6,840,322 B2 1/2005 Haynes
6,892,835 B2 5/2005 Shahin et al.
6,907,934 B2 6/2005 Kauffman et al.
6,938,697 B2 9/2005 Haugen
6,976,298 B1 12/2005 Pietras
7,004,259 B2 2/2006 Pietras
7,028,586 B2 4/2006 Robichaux
7,073,598 B2 7/2006 Haugen
7,090,021 B2 8/2006 Pietras
7,096,977 B2 8/2006 Juhasz et al.
7,100,698 B2 9/2006 Kracik et al.
7,107,875 B2 9/2006 Haugen et al.
7,117,938 B2 10/2006 Hamilton et al.
7,140,445 B2 11/2006 Shahin et al.
7,188,686 B2 3/2007 Folk et al.
7,213,656 B2 5/2007 Pietras
7,325,610 B2 2/2008 Giroux et al.
2001/0042625 A1 11/2001 Appleton
2002/0029878 A1 3/2002 Victor
2002/0108748 A1 8/2002 Keyes
2002/0170720 A1 11/2002 Haugen
2003/0155159 A1 8/2003 Slack et al.
2003/0164276 A1 9/2003 Snider et al.
2003/0173073 A1 9/2003 Snider et al.
2003/0221519 A1 12/2003 Haugen
2004/0003490 A1 1/2004 Shahin et al.
2004/0069500 A1 4/2004 Haugen
2004/0144547 A1 7/2004 Koithan et al.
2004/0173358 A1 9/2004 Haugen
2004/0216924 A1 11/2004 Pietras et al.
2004/0251050 A1 12/2004 Shahin et al.
2004/0251055 A1 12/2004 Shahin et al.
2005/0000691 A1 1/2005 Giroux et al.
2005/0051343 A1 3/2005 Pietras et al.
2005/0096846 A1 5/2005 Koithan et al.
2005/0098352 A1 5/2005 Beierbach et al.
2006/0000600 A1 1/2006 Pietras
2006/0124353 A1 6/2006 Juhasz et al.
2006/0180315 A1 8/2006 Shahin et al.
2007/0000668 A1 1/2007 Christensen 2008/0093127 A1* 4/2008 Angman ..... 175/170

FOREIGN PATENT DOCUMENTS

| | | |
|---|---|---|
| DE | 3 523 221 | 2/1987 |
| EP | 0 087 373 | 8/1983 |
| EP | 0 162 000 | 11/1985 |
| EP | 0 171 144 | 2/1986 |
| EP | 0 285 386 | 10/1988 |
| EP | 0 474 481 | 3/1992 |
| EP | 0 479 583 | 4/1992 |
| EP | 0 525 247 | 2/1993 |
| EP | 0 589 823 | 3/1994 |
| EP | 1148206 | 10/2001 |
| EP | 1 256 691 | 11/2002 |
| GB | 1 469 661 | 4/1977 |
| GB | 2 053 088 | 2/1981 |
| GB | 2 201 912 | 9/1988 |
| GB | 2 223 253 | 4/1990 |
| GB | 2 224 481 | 9/1990 |
| GB | 2 240 799 | 8/1991 |
| GB | 2 275 486 | 4/1993 |
| GB | 2 345 074 | 6/2000 |
| GB | 2 357 530 | 6/2001 |
| JP | 2001-173349 | 6/2001 |
| WO | WO 90-06418 | 6/1990 |
| WO | WO 92-18743 | 10/1992 |
| WO | WO 93-07358 | 4/1993 |
| WO | WO 95-10686 | 4/1995 |
| WO | WO 96-18799 | 6/1996 |
| WO | WO 97-08418 | 3/1997 |
| WO | WO 98-05844 | 2/1998 |
| WO | WO 98-11322 | 3/1998 |
| WO | WO 98-32948 | 7/1998 |
| WO | WO 99-11902 | 3/1999 |
| WO | WO 953-41485 | 8/1999 |
| WO | WO 99-58810 | 11/1999 |
| WO | WO 00-08293 | 2/2000 |
| WO | WO 00-09853 | 2/2000 |
| WO | WO 00-11309 | 3/2000 |
| WO | WO 00-11310 | 3/2000 |
| WO | WO 00-11311 | 3/2000 |
| WO | WO 00-39429 | 7/2000 |
| WO | WO 00-39430 | 7/2000 |
| WO | WO 00-50730 | 8/2000 |
| WO | WO 01-12946 | 2/2001 |
| WO | WO 01/33033 | 5/2001 |
| WO | WO 01-94738 | 12/2001 |
| WO | WO 2004-022903 | 3/2004 |
| WO | WO 2005/090740 | 9/2005 |
| WO | WO 2006/047892 | 5/2006 |

OTHER PUBLICATIONS

Laurent, et al., "A New Generation Drilling Rig: Hydraulically Powered and Computer Controlled," CADE/CAODC Paper 99-120, CADE/CAODC Spring Drilling Conference, Apr. 7 & 8, 1999, 14 pages.

Laurent, et al., "Hydraulic Rig Supports Casing Drilling," World Oil, Sep. 1999, pp. 61-68.

Shepard, et al., "Casing Drilling: An Emerging Technology," IADC/SPE Paper 67731, SPE/IADC Drilling Conference, Feb. 27-Mar. 1, 2001, pp. 1-13.

Warren, et al., "Casing Drilling Technology Moves to More Challenging Application," AADE Paper 01-NC-HO-32, AADE National Drilling Conference, Mar. 27-29, 2001, pp. 1-10.

Fontenot, et al., "New Rig Design Enhances Casing Drilling Operations in Lobo Trend," paper WOCD-0306-04, World Oil Casing Drilling Technical Conference, Mar. 6-7, 2003, pp. 1-13.

Vincent, et al., "Liner and Casing Drilling—Case Histories and Technology," Paper WOCD-0307-02, World Oil Casing Drilling Technical Conference, Mar. 6-7, 2003, pp. 1-20.

Tessari, et al., "Retrievable Tools Provide Flexibility for Casing Drilling," Paper No. WOCD-0306-01, World Oil Casing Drilling Technical Conference, 2003, pp. 1-11.

Tommy Warren, SPE, Bruce Houtchens, SPE, Garret Madell, SPE, Directional Drilling With Casing, SPE/IADC 79914, Tesco Corporation, SPE/IADC Drilling Conference 2003.

LaFleur Petroleum Services, Inc., "Autoseal Circulating Head," Engineering Manufacturing, 1992, 11 Pages.

Canrig Top Drive Drilling Systems, Harts Petroleum Engineer International, Feb. 1997, 2 Pages.

The Original Portable Top Drive Drilling System, TESCO Drilling Technology, 1997.

Mike Killalea, Portable Top Drives: What's Driving the Marked?, IADC, Drilling Contractor, Sep. 1994, 4 Pages.

500 or 650 ECIS Top Drive, Advanced Permanent Magnet Motor Technology, TESCO Drilling Technology, Apr. 1998, 2 Pages.

500 or 650 HCIS Top Drive, Powerful Hydraulic Compact Top Drive Drilling System, TESCO Drilling Technology, Apr. 1998, 2 Pages.

Product Information (Sections 1-10) CANRIG Drilling Technology, Ltd., Sep. 18, 1996.

Coiled Tubing Handbook, World Oil, Gulf Publishing Company, 1993.

G H. Kamphorst, G. L. Van Wechem, W. Boom, D. Bottger, and K. Koch, Casing Running Tool, SPE/IADC 52770.

Dennis L. Bickford and Mark J. Mabile, Casing Drilling Rig Selection for Stratton Field, Texas, World Oil. vol. 228 No., Mar. 2005.

GB Search Report, GB0601001.1, dated Apr. 4, 2006.

Canadian Office Action, Application No. 2,533,115, dated Feb. 23, 2009.

Great Britain Examination Report, Application No. GB0601001.1, dated Apr. 1, 2009.

* cited by examiner

TOP DRIVE TORQUE BOOSTER

CROSS-REFERENCE TO RELATED APPLICATIONS

This application claims benefit of co-pending U.S. Provisional Patent Application Ser. No. 60/644,661, filed on Jan. 18, 2005, which application is herein incorporated by reference in its entirety.

BACKGROUND OF THE INVENTION

1. Field of the Invention

Embodiments of the present invention generally relate to obtaining hydrocarbon fluid from a wellbore. More specifically, embodiments of the present invention relate to connecting tubulars and drilling the wellbore using tubulars.

2. Description of the Related Art

To obtain hydrocarbon fluid from the earth, a wellbore is formed in the earth. The wellbore is typically drilled using a drill string having a drill bit connected to its lower end. The drill string is rotated and lowered into the earth to form the wellbore.

After the wellbore is drilled to a first depth, the drill string is removed from the wellbore. To prevent collapse of the wellbore wall, casing is often used to line the wellbore. Lining the wellbore involves lowering the casing into the drilled-out wellbore and setting the casing therein.

Casing is usually provided by the manufacturer in sections of a predetermined length; however, the length of casing which is desired for use in lining a section of the wellbore is often longer than the section length. To obtain the desired length of casing for use in lining the wellbore section, casing sections are often connected to one another to form a casing string. Typical casing sections are connected to one another by threaded connections.

Threadedly connecting casing sections to one another involves rotating one casing section relative to the other casing section. A first casing section is lowered partially into the wellbore and gripped by a gripping mechanism such as a spider to prevent rotational movement of the first casing section. The spider is located on or in the rig floor of a drilling rig disposed over the wellbore. A second casing section is then gripped and rotated relative to the first casing section to form the casing string by connecting the upper end of the first casing section to the lower end of the second casing section. Additional casing sections may be threadedly connected to the casing string in the same manner to add to the length of the casing string.

Various tools are utilized to rotate casing sections to make up these threaded connections (or break out the threaded connections when removing casing sections from the casing string) and to rotate the drill string to form the wellbore. One such tool is a top drive, which includes a motor for providing rotational force to the casing or drill string (both hereinafter referred to as "tubular"). The top drive is connected to the drilling rig and moveable relative thereto.

The lower end of the top drive is usually operatively connected to an apparatus for gripping the tubular so that the top drive is capable of rotating the tubular. The gripping apparatus is rotatable by the top drive relative to the top drive and the drilling rig.

Recently, an alternative method of lining the wellbore is proposed which involves drilling the wellbore with the casing which is used to line the wellbore, termed "drilling with casing." In this method, the casing is rotated and lowered into the earth to form the wellbore. Casing sections may be threadedly connected to one another to form a casing string of a desired length or disconnected from one another to reduce the length of the casing string in a casing makeup or breakout operation. Drilling with casing is advantageous because drilling the wellbore and lining the wellbore is accomplished in only one step, saving valuable rig time and resources.

Some have suggested using the gripping apparatus in a drilling with casing operation to grip the casing and using the top drive to rotate the casing when drilling the casing into the wellbore and when making up or breaking out threaded connections. Using the gripping apparatus and the top drive in a drilling with casing operation is particularly attractive if the gripping apparatus and the top drive are capable of fluid flow therethrough to allow the typical circulation of fluid through the wellbore while drilling. The circulation of fluid through the casing and the wellbore removes the cuttings from the wellbore, the cuttings resulting from the drilling into the earth to form the wellbore.

Regardless of whether the operation involves drilling with casing or typical drilling and subsequent casing of the wellbore, existing top drives are only capable of imparting a specific range of torque to the drill string or casing. Often, because of their limited torque-providing capability, the existing top drives fail to supply sufficient torque to the drill string and/or casing to adequately affect the tubular drilling, running, and makeup and breakout operations. High output torque from the top drive is especially desirable for drilling with casing operations, as existing casing connections require torque above the capabilities of most currently-installed drives.

Therefore, it is desirable to provide additional torque capacity to a top drive system for use in rotating a tubular during running, drilling, and/or pipe handling operations. It is further desirable to provide this additional torque capacity for retrofitting to existing top drive systems.

SUMMARY OF THE INVENTION

In one embodiment, a top drive assembly comprises a top drive capable of providing a first torque to a tubular and a torque boosting mechanism operatively connected to the top drive, the torque boosting mechanism capable of providing a second, additional torque to the tubular.

In another embodiment, a method of manipulating a tubular comprises a top drive assembly comprising a top drive operatively connected to a torque altering mechanism; providing a first torque to the tubular using the top drive; and selectively adding a second torque to the tubular using the torque altering mechanism.

In yet another embodiment, a method of selectively providing rotational force to a tubular comprises providing a first torque source operatively connected to a second torque source; rotating the tubular at a first torque by activating the first torque source; and selectively rotating the tubular at a second torque by activating the second torque source.

In yet another embodiment, a method of selectively providing rotational force to a wellbore tubular comprises providing a torque supplying mechanism having an output shaft; coupling a torque altering mechanism to the output shaft and the wellbore tubular; rotating the output shaft at a first speed; and activating the torque altering mechanism to rotate the wellbore tubular at a second speed.

In yet another embodiment, a method of selectively providing rotational force to a wellbore tubular comprises providing a torque supplying mechanism having an output shaft; coupling a torque altering mechanism to the output shaft and the wellbore tubular; rotating the output shaft at a first torque;

and activating the torque altering mechanism to rotate the wellbore tubular at a second torque.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Embodiments of the present invention advantageously increase the torque capacity of a top drive system to permit increased torque impartation upon a tubular rotated by the top drive system. Embodiments of the present invention inexpensively and easily boost the torque capacity of an existing top drive system for tubular running, drilling, and/or handling operations.

Figure 1:
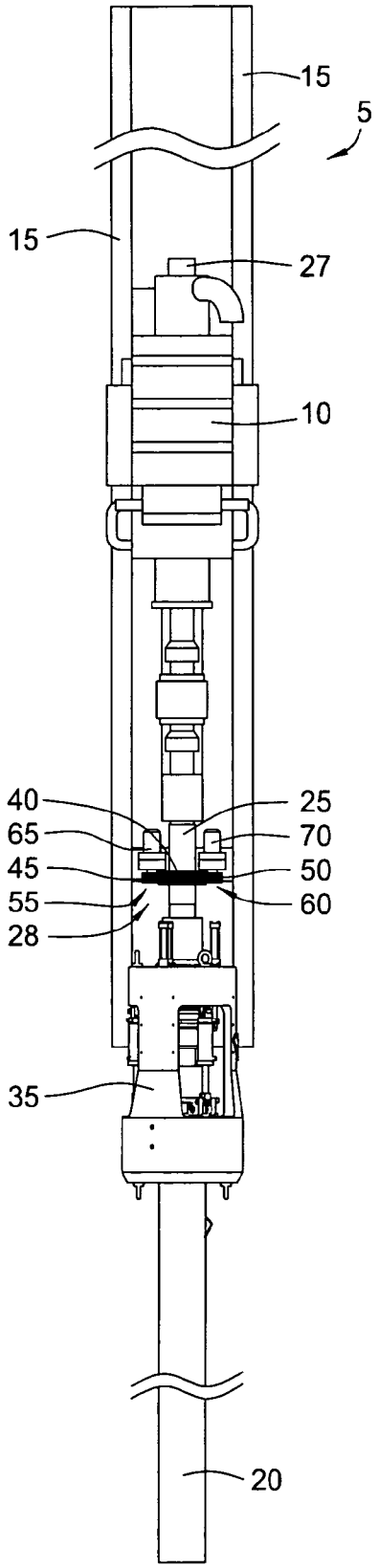
FIG. 1 is a front section view of a first embodiment of a top drive system. The top drive system includes a motor/gear arrangement therein for boosting the torque capacity of the top drive system.
Figure 2:
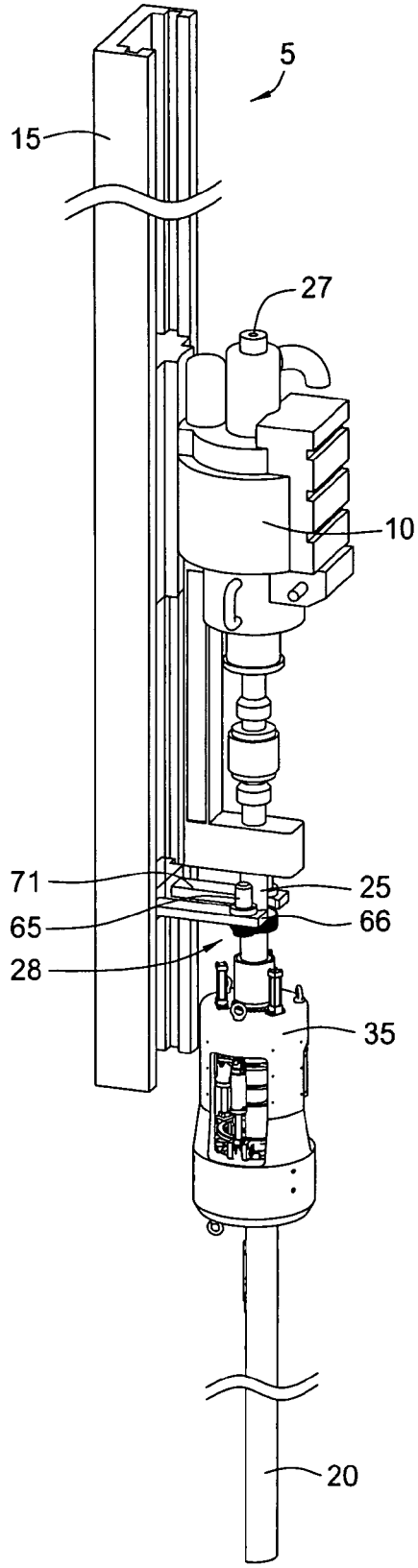
FIG. 2 is a side perspective view of the top drive system of the first embodiment.
Figure 2A:
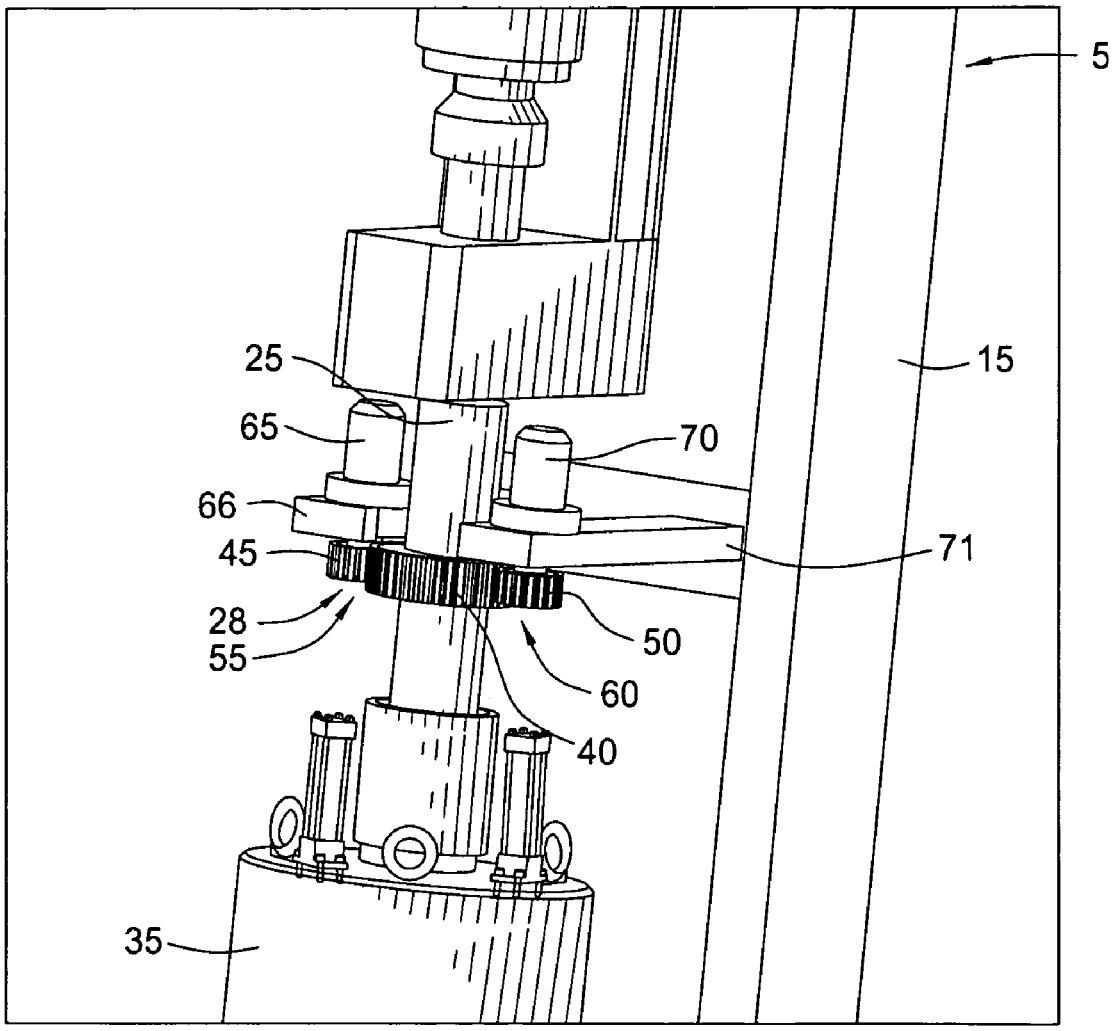
FIG. 2A is a perspective view of a section of the top drive system of FIG. 2.

FIGS. 1, 2, and 2A illustrate various views of a first embodiment of a top drive drilling system 5 for rotating a tubular 20. The top drive drilling system 5 includes a top drive 10 slidable over a track 15. The track 15 is connected to a drilling rig (not shown) which is located over a wellbore (not shown) formed in an earth formation. The top drive 10 is operatively connected at its upper end at the upper connecting member 27 to a draw works (not shown) extending from the drilling rig which is capable of lowering and raising the top drive 10 longitudinally over its track 15.

The top drive 10 is capable of rotating a top drive output shaft 25 to ultimately provide rotational force for rotating the tubular 20. A gear/motor arrangement 28 is disposed around the top drive output shaft 25. The top drive output shaft 25 is capable of applying an increased torque to the output shaft 25, as opposed to the torque applied to the output shaft 25 which is output by the top drive 10, due to the additional torque capacity provided by operation of the gear arrangement 28 (when the gear arrangement 28 is activated to act upon the top drive output shaft 25).

The top drive output shaft 25 may be operatively connected to a gripping head, which is shown as an externally-gripping torque head 35 (grippingly engages an external surface of the tubular) in FIGS. 1 and 2. The gripping head may instead be an internal gripping mechanism (grippingly engages an internal surface of the tubular) such as a spear, or any other type of gripping mechanism known to those skilled in the art. An exemplary spear is illustrated and described in co-pending U.S. patent application Ser. No. 10/967,387 filed on Oct. 18, 2004, which is herein incorporated by reference in its entirety. An example of a torque head is described and depicted in co-pending U.S. patent application Ser. No. 10/625,840 filed on Jul. 23, 2003, which is herein incorporated by reference in its entirety. Preferably, the gripping head is capable of gripping pipes of various diameters to allow use of the same gripping head for drilling as well as casing operations when conducting a conventional drilling operation. Furthermore, the gripping head is also preferably capable of fluid flow therethrough for use in a drilling with casing operation where fluid may flow into a bore of the casing through the top drive and the gripping head.

An external surface of the tubular 20 is shown grippingly engaged by the torque head 35. In this position, the tubular 20 may be rotated by the top drive drilling system 5 and/or a fluid may sealingly flow through the entire top drive drilling system 5 and into and through the tubular 20, as desired. Alternatively, the output shaft 25 may be connected directly to the tubular 20.

The gear arrangement 28 is more clearly shown in FIG. 2A. Surrounding the top drive output shaft 25 is a gear 40, which includes a plurality of teeth in its outer surface. A first gear 45 and optionally a second gear 50 are located on opposite sides of the outer surface of the gear 40 and also include a plurality of teeth in each of their outer surfaces. The teeth of the gears 45 and 50 are capable of cooperating or engaging with the teeth of the gear 40 to rotate the gear 40. The first and second gears 45 and 50 are preferably pinions, so that the gear 40 and the pinions 45 and 50 combine to form a gear and pinion arrangement.

The first gear 45 is a portion of a first gear drive 55, while the optional second gear 50 is a portion of an optional second gear drive 60. A first motor 65 of the first gear drive 55 is capable of providing rotational force to rotate the first gear 45, and an optional second motor 70 is capable of providing rotational force to rotate the optional second gear 50. The first and second gear drives 55 and 60, through the rotational force of the first and second gears 45 and 50, cooperate to rotate the gear 40. (When the second gear drive 60 is not utilized as part of embodiments of the present invention, only the first drive 55 rotates the first gear 45 and only the first gear 45 rotates the gear 40.)

The first motor 65 rests on a first support 66 extending from the top drive track 5 and includes a rotor (not shown) extending through the first support 66 and through the first gear 45. Likewise, the second motor 70 is located on a second support 71 extending from the track 15 and includes a rotor (not shown) extending through the second support 71 and through the second gear 50. The first support 66 may be disposed on an opposite side of the shaft 25 from the second support 71 (and so may their associated gear drives 55 and 60). Other support arrangements are within the scope of embodiments of the present invention, for example if only one gear drive 55 is utilized to rotate the gear 40.

The first and second motors 65 and 70 are capable of rotating their respective rotors with respect to the first and second supports 66 and 71 to rotate the first and second gears 45 and 50, respectively, thereby adding power to the system. The first and second motors 65 and 70 may be electrically, mechanically, and/or fluid powered by any method known to those skilled in the art. Preferably, the first and second motors 65 and 70 are fluid-powered.

In operation, referring to FIGS. 1 and 2, the tubular 20 is grippingly and sealingly engaged by the torque head 35. The torque head 35 may grippingly engage the tubular 20 by lowering the draw works towards the rig floor so that the torque head 35 envelops the tubular 20 and by then activating one or more slip arrangements to grip the tubular 20 within the torque head 35. The draw works is used to lower or raise the tubular 20 longitudinally while the tubular 20 is being gripped by the torque head 35 (or to pick up a tubular from the rig floor or from a rack away from the rig floor using the torque head 35). When it is desired to rotate the tubular 20 using the top drive drilling system 5, e.g., for drilling with a tubular (which may be casing) or for rotating a tubular relative to another tubular during a pipe handling operation (make-up or break-out operation), the top drive 10 is activated to rotate the top drive output shaft 25 at a first speed and provide a first torque to the top drive output shaft 25.

At any point during the pipe handling or drilling operation, if it is desired to apply additional torque to the tubular 20 (i.e., boost the amount of torque applied to the tubular 20), the first and second motors 65 and 70 are selectively activated to rotate the first and second gears 45 and 50. The teeth of the first and second gears 45 and 50 then cooperate with the teeth of the gear 40 to rotate the gear 40. The gear 40 applies the additional torque provided by the first and second gear drives 55 and 60 to the top drive output shaft 25. Therefore, when the gear arrangement 28 is activated, the amount of torque applied to the top drive output shaft 25 (and therefore the amount of torque applied to the tubular 20 via the torque head 35) is not limited to the amount of torque which the top drive 10 is capable of applying to the top drive output shaft 25 and tubular 20, but is instead equal to the sum of the amount of torque applied by the top drive 10 plus the amount of torque applied by the gear arrangement 28. The amount of torque applied by the gear arrangement 28 may be adjusted as desired before, during, or after the operation.

After applying the desired amount of torque to the tubular 20, the torque head 35 may be released from gripping engagement with the tubular 20. The torque head 35 may then be utilized to grippingly engage an additional tubular (not shown), and the top drive 10 and/or the gear arrangement 28 may again be activated to rotate the additional tubular using the desired amount of torque.

Figure 3:
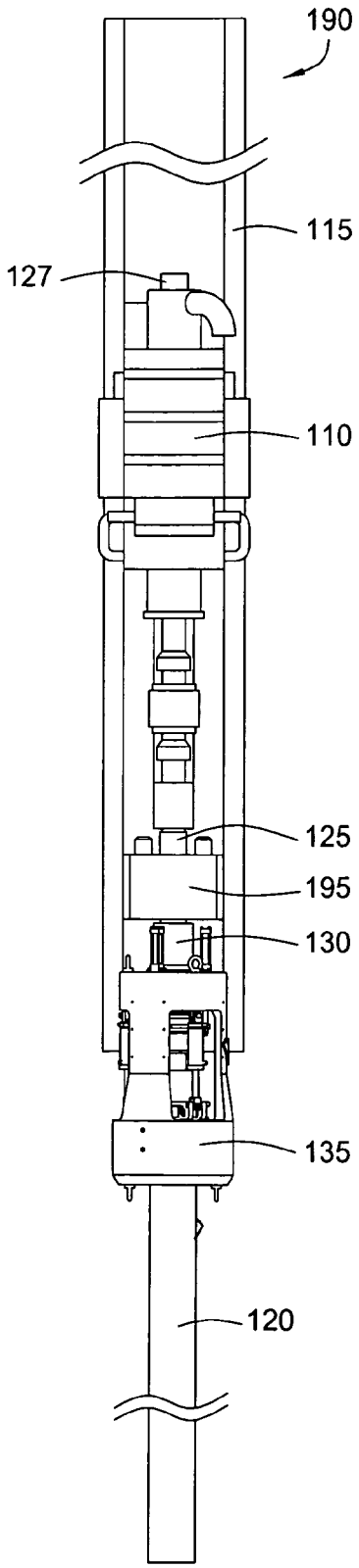
FIG. 3 is a front section view of a second embodiment of a top drive system. This top drive system includes a gear box therein for boosting the torque capacity of the top drive system.
Figure 4:
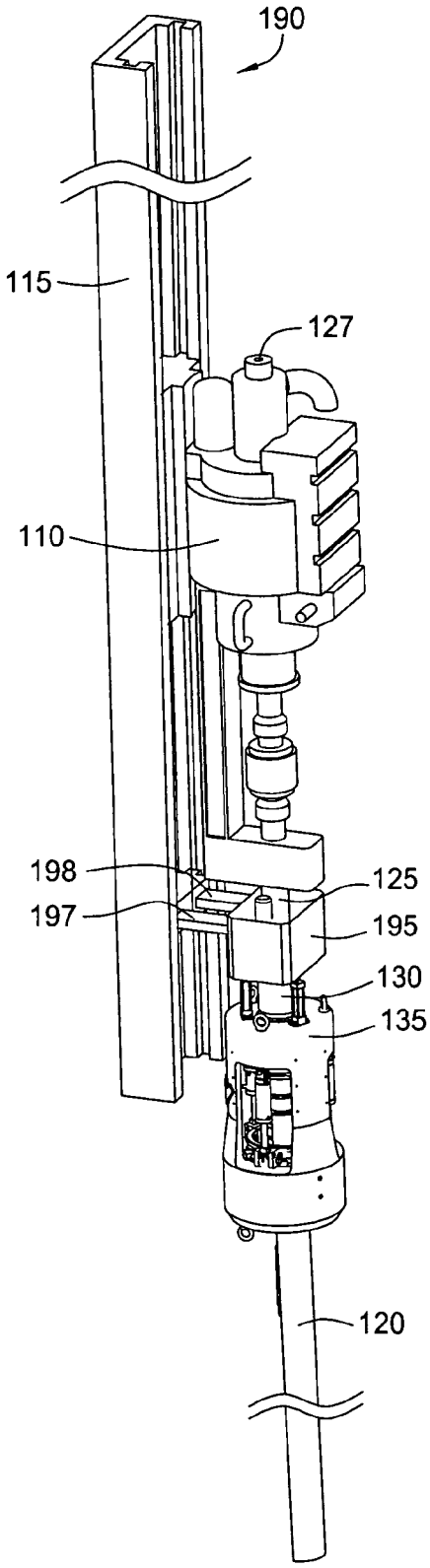
FIG. 4 is a side perspective view of the top drive system of the second embodiment.

FIGS. 3 and 4 represent views of a second embodiment of a top drive drilling system 190 for rotating a tubular 120. The components of the second embodiment which are substantially the same as components of the first embodiment are represented by the same numbers, but in the "100" series. Therefore, the structures and operations of the track 115, top drive 110, torque head 135, and tubular 120 shown in FIGS. 3 and 4 are at least substantially the same as the structures and operations of the track 15, top drive 10, torque head 35, and tubular 20 shown and described above in relation to FIGS. 1-2A.

The difference between the first embodiment and the second embodiment is that the gear arrangement 28 of the first embodiment is replaced with a gear box 195 in the top drive drilling system 190 of the second embodiment, as shown in FIGS. 3 and 4. The gear box 195 is mounted to the track 115 by first and second supports 197 and 198 in FIGS. 3 and 4, although other support arrangements are within the scope of embodiments of the present invention. Another difference between the gear box 195 embodiment and the gear arrangement 28 embodiment is that the gear box 195 embodiment includes an input shaft 125 inputted into the gear box 195 and operatively connected to the top drive 110 and a separate output shaft 130 outputted from the gear box 195 and operatively connected to the gripping head 135. The shafts 125, 130 are capable of rotating at different speeds and at different torques from one another upon activation of the gear box 195 (the speed and torque of the tubular have an inverse relationship). Alternatively, the output shaft 130 may be connected directly to the tubular 20.

As described above in relation to the gear arrangement 28 of the first embodiment, the primary function of the gear box 195 is to increase the torque capacity of the top drive 110. To accomplish this task, the gear box 195 is capable of rotating the gear output shaft 130 at a lower rate of speed (but higher torque) than the speed at which the top drive is capable of rotating the top drive output shaft 125, which is the input shaft to the gear box 195.

The gear box 195 preferably is planetary with rotating seals, where an input shaft drives a planet and a ring gear drives an output shaft. Furthermore, the gear box 195 is preferably shiftable to allow switching to different speeds, for example switching from a 1:2 or 2:1 speed or torque ratio to a different speed or torque ratio so that the gear option is 1:1. Although any type of gear box known to those skilled in the art is usable with the present invention, an exemplary gear box usable as part of the present invention is preferably planetary and co-axial with an input and output shaft to change speed and torque, as shown and described in U.S. Pat. No. 5,385,514 issued on Jan. 31, 1995, which is herein incorporated by reference in its entirety. The gear box used as part of the present invention preferably is shiftable such as the gear box shown and described in U.S. Pat. No. 6,354,165 issued on Mar. 12, 2002, which is also herein incorporated by reference in its entirety.

An advantage of utilizing the gear box 195 as the torque booster is that the gear box 195 may be set to provide a given ratio of additional torque to the gear output shaft 130 relative to the torque provided to the top drive output shaft 125, e.g., the gear box 195 may provide an input to output torque ratio of 1:2 to double the torque (thereby decreasing the speed of rotation of the tubular by ½). It is contemplated that the gear box may also be used to alter the speed of the gear output shaft 130 such that torque is decreased, e.g., the gear box 195 may provide an input to output torque ratio of 2:1 to reduce the torque by half. An additional advantage in using the gear box 195 is that there are no exposed rotating parts involved with the operation of the gear box 195 itself.

The operation of the top drive drilling system 190 is similar to the operation of the top drive drilling system 5. When it is desirable to add to the amount of torque supplied by the top drive 110 for rotating the tubular 120, the gear box 195 is selectively activated to increase the amount of torque applied to the gear output shaft 130, torque head 135, and tubular 120. The gear box 195 possesses a bore therethrough to allow drilling fluid and/or wireline to pass through the gear box 195 during the drilling, casing, and/or pipe handling operation.

The first and second embodiments described above include various forms of a top drive torque booster, including specifically the gear box 195 and the gear arrangement 28. Other types of torque boosters known to those skilled in the art are usable as part of the present invention, including but not limited to chain connections (rotationally connecting the gears by chains when the gears are separated from one another) or any other torque-transmitting couplings, as well as any other gear mechanisms known to those skilled in the art.

The ability to apply additional torque afforded by adding a torque booster, regardless of the type, to the top drive system is especially advantageous in retrofitting existing top drives, which often possess a limited torque capacity, with additional torque capabilities. Increasing the torquing ability of the top drive 10, 110 is particularly useful in casing running and casing drilling operations, where additional torque is sometimes required to rotate the casing or connect casing threads. The torque booster is capable of monitoring and controlling the amount of torque provided to the tubular gripped by the gripping head.

In an alternate embodiment, the top drive may be eliminated in any of the above-described embodiments, and the torque booster may be utilized as the only device for providing torque to the tubular. In a further alternate embodiment, the gripping head may be eliminated and replaced by another type of tubular gripping mechanism, such as an elevator. Yet a further alternate embodiment involves including a gear reducer instead of the torque booster if it is desired to selectively decrease the amount of torque applied by the top drive.

The torque booster is usable in a drilling with casing, casing lowering, casing make-up or break-out, tubular or drill pipe make-up or break-out, tubular or drill pipe lowering, or tubular or drill pipe drilling operation, or any other operation which requires rotating, lowering, and/or drilling a tubular body for placement of or while placing the tubular body into a wellbore within a formation. Directional terms stated herein, including "upper" and "lower," for example, are merely indications of relative movements of objects and are not limiting.

Although increasing the capacity of torque applicable by the top drive is accomplished by the gear box described above, it is also within the scope of embodiments of the present invention to merely use the gear box to decrease the amount of torque which it is necessary to apply to the tubular using the top drive during a given operation (to allow the top drive to operate below its torque capacity), thereupon reducing wear and tear on the top drive unit. Additionally, the gear box may be utilized as a spinner to spin the tubular without adding torque to the top drive by operating in neutral or by adding a lesser amount of torque for a portion of the threading operation, and then the speed of rotation of and torque to the tubular may be changed at the thread-makeup point by shifting the speed (torque) which the gear box provides to the tubular at this point. For example, the gear box may be shifted to change from a high speed output, low torque to a low speed output, high torque.

In another embodiment, a method of selectively providing rotational force to a wellbore tubular comprises providing a torque supplying mechanism having an output shaft; coupling a torque altering mechanism to the output shaft and the wellbore tubular; rotating the output shaft at a first speed; and activating the torque altering mechanism to rotate the wellbore tubular at a second speed.

In another embodiment, a method of selectively providing rotational force to a wellbore tubular comprises providing a torque supplying mechanism having an output shaft; coupling a torque altering mechanism to the output shaft and the wellbore tubular; rotating the output shaft at a first torque; and activating the torque altering mechanism to rotate the wellbore tubular at a second torque.

In one or more of the embodiments disclosed herein, the first speed is higher than the second speed.

In one or more of the embodiments disclosed herein, the first speed is lower than the second speed.

In one or more of the embodiments disclosed herein, rotating the tubular connects the tubular to another tubular.

In one or more of the embodiments disclosed herein, the torque altering mechanism comprises a gear arrangement.

In one or more of the embodiments disclosed herein, the torque supplying mechanism comprises a top drive.

In one or more of the embodiments disclosed herein, the torque altering mechanism is coupled to the wellbore tubular using a gripping mechanism.

In one or more of the embodiments disclosed herein, the gripping mechanism is one of a gripping head or an internal gripping mechanism.

In one or more of the embodiments disclosed herein, the wellbore tubular is connected to an output shaft of the torque altering mechanism.

In one or more of the embodiments disclosed herein, the first torque is higher than the second torque.

In one or more of the embodiments disclosed herein, the first torque is lower than the second torque.

While the foregoing is directed to embodiments of the present invention, other and further embodiments of the invention may be devised without departing from the basic scope thereof, and the scope thereof is determined by the claims that follow.

We claim:

1. A method of manipulating a tubular, comprising:

providing a top drive assembly comprising a top drive having an output shaft operatively connected to a torque altering mechanism having a motor;

applying a first torque to the tubular using the top drive to rotate the tubular;

engaging the output shaft with the torque altering mechanism in both an activated and deactivated state while the tubular is being rotated by the top drive; and selectively adding a second torque to the tubular using the torque altering mechanism simultaneously with the first torque provided by the top drive, wherein the second torque is provided independent of the first torque.

2. The method of claim 1, further comprising grippingly engaging the tubular and transmitting the first and second torque to the tubular using a gripping mechanism.

3. The method of claim 2, wherein the gripping mechanism grippingly engages an outer surface of the tubular.

4. The method of claim 2, wherein the gripping mechanism grippingly engages an inner surface of the tubular.

5. The method of claim 1, wherein the tubular is casing.

6. The method of claim 5, further comprising forming a wellbore with the casing using the first torque and selectively using the second torque.

7. The method of claim 6, further comprising circulating a fluid through the top drive assembly and the casing.

8. The method of claim 1, further comprising rotating the tubular with respect to another tubular using the first torque and selectively using the second torque.

9. The method of claim 1, further comprising rotating the tubular and then selectively adding the second torque to the tubular while the tubular is rotating.

10. A method of selectively providing rotational force to a tubular, comprising:

providing a top drive having an output shaft coupled to the tubular;

coupling a torque altering mechanism to the output shaft;

rotating the output shaft at a first speed using the top drive;

rotating the output shaft at least one revolution using the torque altering mechanism, wherein the torque altering mechanism is operable to rotate the output shaft at a second speed independent of the first speed;

wherein the top drive and the torque altering mechanism are simultaneously operated to rotate the wellbore tubular at a third speed; and deactivating the torque altering mechanism so that it does not rotate the tubular but remains engaged with the output shaft while the tubular is being rotated by the top drive.

11. The method of claim 10, wherein the first speed is higher than the second speed.

12. The method of claim 10, wherein the first speed is lower than the second speed.

13. The method of claim 10, wherein rotating the tubular connects the tubular to another tubular.

14. The method of claim 10, wherein the torque altering mechanism comprises a gear arrangement.

15. The method of claim 10, wherein the output shaft is coupled to the tubular using a gripping mechanism.

16. The method of claim 15, wherein the gripping mechanism is one of a gripping head or an internal gripping mechanism.

17. The method of claim 10, wherein the output shaft and the tubular rotate in the same direction.

18. The method of claim 10, wherein the torque altering mechanism comprises a motor for providing the second speed.

19. A method of selectively providing rotational force to a tubular, comprising:

providing a top drive having an output shaft coupled to the tubular;

providing a torque altering mechanism that is continuously engaged with the output shaft while activated and deactivated;

rotating the output shaft at a first torque using the top drive, wherein the torque altering mechanism is operable to rotate the output shaft at a second torque independent of the first torque; and simultaneously operating the top drive and the torque altering mechanism to rotate the tubular at a third torque.

20. The method of claim 19, wherein the output shaft and the tubular rotate in the same direction.

21. The method of claim 19, wherein the torque altering mechanism comprises a motor for providing the second torque.

22. A method of selectively providing rotational force to a tubular, comprising:

providing a top drive having an output shaft coupled to the tubular;

coupling a torque altering mechanism to the output shaft;

applying a torque to the output shaft using the top drive to rotate the tubular at a first speed;

activating the torque altering mechanism to change the torque applied to the output shaft while the tubular is rotating at the first speed, thereby causing the tubular to rotate at a second speed, wherein the torque altering mechanism is activated independent of the top drive; and deactivating the torque altering mechanism while maintaining engagement with the output shaft being rotated by the top drive.

23. The method of claim 22, wherein the torque altering mechanism comprises a motor for providing torque.

24. A top drive assembly, comprising:

a top drive having an output shaft for providing a first torque to a tubular; and a torque boosting source for providing a second torque to the tubular independent from the first torque provided by the top drive, wherein the torque boosting source is operatively connected to the output shaft such that the torque boosting source and the top drive are jointly capable of providing a third torque to the tubular, and wherein the torque boosting source is engaged with the output shaft in activated and deactivated states while the tubular is in a continuous rotative state.

25. The assembly of claim 24, wherein the third torque comprises the first torque plus the second torque.

26. The assembly of claim 24, wherein the torque boosting source is selectively activated to provide the second torque.

27. The assembly of claim 24, wherein the toque boosting source is offset from a longitudinal axis of the tubular.

28. The assembly of claim 24, wherein the toque boosting source is offset from a longitudinal axis of the top drive.

29. The assembly of claim 24, wherein the torque boosting source comprises a motor for providing the second torque.

30. The assembly of claim 24, wherein the output shaft has a gear surrounding the output shaft.

31. The assembly of claim 30, wherein the torque boosting source includes a first gear that is meshed with the gear surrounding the output shaft when activated and deactivated.

32. The assembly of claim 31, wherein the torque boosting source includes a motor operatively coupled to the first gear for rotating the first gear, thereby providing the second torque.

33. The assembly of claim 32, wherein the motor is at least one of electrically, mechanically, and hydraulically powered.

34. A method of selectively providing rotational force to a tubular, comprising:

providing a top drive having an output shaft for rotating the tubular;

engaging a torque boosting source to the output shaft while the torque boosting source is in a deactivated state;

transmitting a first torque from the output shaft to rotate the tubular;

selectively activating the torque boosting source to apply a second torque to the tubular, wherein the second torque is provided independent of the first torque provided by the top drive, thereby rotating the tubular at a combination of the first torque and the second torque.

35. The method of claim 34, wherein engaging the output shaft comprises engaging a gear arrangement of the torque boosting source to the output shaft.

36. The method of claim 35, wherein the torque boosting source comprises a motor for providing the second torque.

* * * * *